US006723687B2

(12) United States Patent
Clare

(10) Patent No.: US 6,723,687 B2
(45) Date of Patent: Apr. 20, 2004

(54) AUTOMATIC DISHWASHING COMPOSITIONS COMPRISING DIACYL PEROXIDE BLEACH AND BLOOMING PERFUME

(75) Inventor: Jonathan Richard Clare, Newcastle-Upon-Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 95 days.

(21) Appl. No.: 09/846,654

(22) Filed: May 1, 2001

(65) Prior Publication Data

US 2003/0022805 A1 Jan. 30, 2003

(51) Int. Cl.[7] ..... C11D 3/50

(52) U.S. Cl. ..... 510/101; 510/220; 510/221; 510/372

(58) Field of Search ..... 510/101, 220, 510/221, 372

(56) References Cited

U.S. PATENT DOCUMENTS 5,089,162 A 2/1992 Rapisarda et al.
5,763,378 A * 6/1998 Painter et al. ..... 510/224
6,143,707 A 11/2000 Trinh et al.

FOREIGN PATENT DOCUMENTS

WO WO 97/34987 * 9/1997

* cited by examiner

*Primary Examiner*—John Hardee
(74) *Attorney, Agent, or Firm*—Donald E. Hasse; Kevin L. Waugh

(57) ABSTRACT

Automatic dishwashing detergent compositions comprising diacyl peroxide bleaching agent and blooming perfume composition containing blooming perfume ingredients having a boiling point of less than about 260° C. and a ClogP of at least about 3, and delayed blooming perfume ingredients having a boiling point of less than about 260° and a ClogP of less than about 3, wherein the weight ratio of blooming perfume ingredients to delayed blooming perfume ingredients is from about 0.25 to about 1.5.

20 Claims, No Drawings

AUTOMATIC DISHWASHING COMPOSITIONS COMPRISING DIACYL PEROXIDE BLEACH AND BLOOMING PERFUME

This application claims priority to U.S. patent application Ser. No. 09/783510 filed Feb. 14, 2001.

TECHNICAL FIELD

The present invention relates to automatic dishwashing detergent compositions comprising a diacyl peroxide bleaching agent and a blooming perfume composition containing blooming perfume ingredients and delayed blooming perfume ingredients. Preferred methods for cleaning dishware are included.

BACKGROUND OF THE INVENTION

Builders, surfactants, alkalinity, and bleaching chemicals traditionally have been used in automatic dishwashing detergent (ADD) compositions to promote soil removal from dishes, soil antiredeposition and anti-spotting benefits. However, strong alkalis like sodium hydroxide and bleaches such as hypochlorite can be damaging to, or leave a film upon, glasses, dishware or silverware. Accordingly, milder ADD compositions have been developed that make use of a source of hydrogen peroxide. Diacyl peroxide bleaching agents are particularly effective at removing stains, especially carotenoid, from plastic dishware. However, such bleaching agents have strong base odors that can be difficult to mask or cover up with perfume compositions. This is especially true in liquid, gel and paste compositions where the bleaching agents can more readily degrade or react with other ingredients in the composition and introduce off odors.

Plastic dishware also tends to pickup residual food malodors or other malodors from the dishwashing process. It is desirable to formulate perfume compositions for ADD products that can cover up or mask such malodors and give the impression that washed items, particularly plastic dishware, are fresh and clean at the end of the washing cycle when the consumer removes them from the machine. However, the perfume smell should not linger significantly or adhere noticeably to the washed items.

U.S. Pat. No. 6,143,707, Trinh et al, issued Nov. 7, 2000, discloses automatic dishwashing detergent compositions comprising blooming perfume compositions containing blooming perfume ingredients, and optionally, delayed blooming perfume ingredients, and non-blooming perfume ingredients. The compositions can also contain bleaching agents, including diacyl peroxides.

U.S. Pat. No. 5,089,162, Rapisarda et al, issued Feb. 18, 1992, discloses cleaning compositions containing bleach-stable yellow colorant and either a chlorine bleach or an oxygen bleach. The compositions may be automatic dishwashing detergents, and preferably have a lemon-like scent. Various perfume ingredients and perfume compositions are disclosed.

SUMMARY OF THE INVENTION

It has now been discovered that automatic dishwashing detergent compositions comprising a blooming perfume composition and an effective amount of a diacyl peroxide bleaching agent can be formulated to provide cleaning and stain removal (e.g., carotenoid stain removal) benefits, while also providing a positive scent signal to consumers during use.

Taken broadly, the present invention encompasses automatic dishwashing detergent compositions comprising, by weight:

(a) from about 0.01% to about 5% of a blooming perfume composition comprising from about 15% to about 60% of blooming perfume ingredients having a boiling point of less than about 260° C. and a ClogP of at least about 3, and from about 15% to about 70% of delayed blooming perfume ingredients having a boiling point of less than about 260° C. and a ClogP of less than about 3, wherein the weight ratio of blooming perfume ingredients to delayed blooming perfume ingredients is from about 0.25 to about 1.5 and said blooming perfume composition comprises at least about 40% by weight of blooming perfume ingredients and delayed blooming perfume ingredients; and (b) an effective amount of diacyl peroxide bleaching agent.

The above blooming perfume composition provides superior perfume effects in that it masks the base odors from the diacyl peroxide bleaching agent in the composition, while providing a pleasant fragrance in the area surrounding the automatic dishwashing machine during and after use. The perfume composition covers up or masks residual food malodors and/or other malodors from the dishwashing process, including on washed items such as plastic dishware that tend to pick up such malodors. The perfume composition thus gives the impression that the washed items are fresh and clean at the end of the washing cycle when the items are removed from the machine. The ingredients of the perfume composition are also selected to minimize residual odor on washed items, particularly plastic items.

The present invention also encompasses cleaning methods; more particularly, a method of washing dishware in a domestic automatic dishwashing appliance, comprising treating soiled dishware in an automatic dishwasher with an aqueous bath comprising the composition as provided above.

All parts, percentages and ratios used herein are expressed as percent weight unless otherwise specified. All documents cited are, in relevant part, incorporated herein by reference.

DETAILED DESCRIPTION OF THE INVENTION

Automatic dishwashing compositions of the present invention comprise a blooming perfume composition and an effective amount of diacyl peroxide bleaching agent, as described in more detail below.

Amounts of the essential ingredients can vary within wide ranges, however preferred automatic dishwashing detergent compositions herein (which have a 1% aqueous solution pH of from about 2 to about 12, more preferably from about 3 to about 11) comprise from about 0.01% to about 5%, preferably from about 0.03% to about 3%, and more preferably from about 0.05% to about 2%, of a blooming perfume composition.

Preferred compositions herein are in the form of liquids, gels or pastes and contain from about 40% to about 99%, preferably from about 60% to about 99%, more preferably from about 80% to about 99%, of water. Because of the reactivity of bleaching agents in such compositions, and the potential for generation of off odors, the benefits provided by the present blooming perfume composition containing base masking perfume ingredients are generally greater in such compositions.

By "effective amount" herein is meant an amount, which is sufficient, under whatever comparative test conditions are employed, to enhance cleaning of a soiled surface. In automatic dishwashing, the soiled surface may be, for example, a plastic container with tomato stains or dishes soiled with simple starches or more complex food soils. The test conditions will vary, depending on the type of washing appliance used and the habits of the user. Of course, the performance of bleaches will be affected by such considerations, and the levels used in fully formulated detergent and cleaning compositions can be appropriately adjusted.

Blooming Perfume Composition

Blooming perfume compositions, as disclosed herein, can be formulated into automatic dishwashing detergent compositions and provide significantly better noticeability to the consumer than non-blooming perfume compositions not containing a substantial amount of blooming perfume ingredients. Additionally, residual perfume is not desirable on many surfaces, including dishes, glasses and cutlery, especially those made of plastic, rubber and silicone.

A blooming perfume ingredient is characterized by its boiling point (B.P.) and its octanol/water partition coefficient (P). The octanol/water partition coefficient of a perfume ingredient is the ratio between its equilibrium concentrations in octanol and in water. The preferred perfume ingredients of this invention have a B.P., determined at the normal, standard pressure of about 760 mm Hg, of about 260° C. or lower, preferably less than about 255° C.; and more preferably less than about 250° C., and an octanol/water partition coefficient P of about 1,000 or higher. Since the partition coefficients of the preferred perfume ingredients of this invention have high values, they are more conveniently given in the form of their logarithm to the base 10, logP. Thus the preferred perfume ingredients of this invention have logP at 25° C. of about 3 or higher.

Boiling points of many perfume compounds can be found in the following sources:

Properties of Organic Compounds Database CD-ROM Ver. 5.0

CRC Press,

Boca Raton, Fla.;

Flavor and Fragrance-1995,

Aldrich Chemical Co.,

Milwaukee, Wis.;

STN database/on-line,

Design Institute of for Physical Property Data,

American Institute of Chemical Engineers;

STN database/on-line,

Beilstein Handbook of Organic Chemistry,

Beilstein Information Systems; and

Perfume and Flavor Chemicals,

Steffen Arctander,

Vol. 1, II-1969.

When unreported, the 760 mm boiling points of perfume ingredients can be estimated. The following computer programs are useful for estimating these boiling points:

MPBPVP Version 1.25 © 1994–96 Meylan

Syracuse Research Corporation (SRC)

Syracuse, N.Y.; and

ZPARC,

ChemLogic, Inc.,

Cambridge, Mass.

The logP of many perfume ingredients has been reported; for example, the Pomona92 database, available from Daylight Chemical Information Systems, Inc. (Daylight CIS), Irvine, Calif., contains many, along with citations to the original literature. However, the logp values are most conveniently calculated by the Pamona Med Chem/Daylight "CLOGP" program, Version 4.42 available from Biobyte Corporation, Claremont, Calif. This program also lists experimental logp values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logp values in the selection of perfume ingredients which are useful in the present invention.

Thus, when a perfume composition which is composed of ingredients having a B.P. of about 260° C. or lower and a ClogP, or an experimental logp, of about 3 or higher, is used in an automatic dishwashing detergent composition, the perfume is very effusive and very noticeable when the product is used.

Table 1 gives some non-limiting examples of blooming perfume ingredients, useful in automatic dishwashing detergent compositions of the present invention. The blooming perfume compositions of the present invention contain at least 2 different blooming perfume ingredients, preferably at least 3 different blooming perfume ingredients, more preferably at least 4 different blooming perfume ingredients, and even more preferably at least 5 or more different blooming perfume ingredients. Furthermore, the blooming perfume compositions of the present invention contain from about 15 to about 60% of blooming perfume ingredients, preferably from about 20 to about 50% of blooming perfume ingredients, more preferably from about 25 to about 40% of blooming perfume ingredients. The blooming perfume compositions herein preferably should not contain any single blooming ingredient at a level that would provide, by weight, more than about 2% of that ingredient to the total dishwashing composition, more preferably not more than about 1.5%, and even more preferably not more than about 0.5%, of the dishwashing composition.

The perfume composition itself preferably should not contain more than 60% of any single perfume ingredient.

Most common perfume ingredients, which are derived from natural sources, are composed of a multitude of components. For example, orange terpenes contain about 90% to about 95% d-limonene, but also contain many other minor ingredients. When each such material is used in the formulation of blooming perfume compositions of the present invention, it is counted as one ingredient, for the purpose of defining the invention. Synthetic reproductions of such natural perfume ingredients are also comprised of a multitude of components and are counted as one ingredient for the purpose of defining the invention.

The blooming perfume composition of the present invention also contain from about 15% to about 70%, preferably from about 20% to about 50%, more preferably from about 25% to about 40%, by weight, of delayed blooming" perfume ingredients. The delayed blooming perfume ingredients of this invention have a B.P., measured at the normal, standard pressure, of about 260° C. or lower, preferably less than about 255° C.; and more preferably less than about 250°

C., and a logP or ClogP of less than about 3. Thus, when a perfume composition is composed of some preferred blooming ingredients and some delayed blooming ingredients, the perfume effect is longer lasting when the product is used. Table 2 gives some non-limiting examples of delayed blooming perfume ingredients useful in automatic dishwashing detergent compositions of the present invention. Delayed blooming perfume ingredients are used primarily in applications where the water will evaporate, thus liberating the perfume.

Plastic dishware items are difficult to get fully dry in an automatic dishwashing machine. Due to the hydrophobic nature of plastic surfaces, water tends to collect in tiny droplets which evaporate less readily from the surface than does the thin water film formed on less hydrophobic surfaces such as ceramics. This slower drying of plastic surfaces is used to advantage in the present compositions where, because of the high concentration of delayed blooming ingredients, there will be a constant release of perfume materials from the perfume dispersed in the tiny water droplets on plastic dishware surfaces. This will occur over a longer period than for conventional blooming perfumes due to the relatively high level of delayed blooming perfume ingredients in the present compositions. Thus, plastic items removed from the dishwasher even a considerable time after the cycle has finished will give the impression of being clean and fresh, and any malodors will be masked. A major advantage of this approach is that the delayed blooming perfume ingredients are not very residual to the plastic since they are not very hydrophobic. The delayed blooming perfume ingredients will thus eventually evaporate with the water droplets, leaving no taint on the plastic dishware.

The weight ratio of blooming perfume ingredients to delayed blooming perfume ingredients in the present compositions should be from about 0.25 to about 1.5, preferably from about 0.5 to about 1.35, more preferably from about 0.75 to about 1.2. The blooming perfume compositions also contain at least about 40 wt. % of the combined blooming perfume ingredients and delayed blooming perfume ingredients, preferably at least about 50 wt. % of the combined perfume ingredients, more preferably at least about 55 wt. % of the combined perfume ingredients, and even more preferably at least about 60 wt. % of the combined perfume ingredients. The blooming perfume compositions of the present invention contain at least 2 different delayed blooming perfume ingredients, preferably at least 3 different delayed blooming perfume ingredients, and more preferably at least 4 or more different delayed blooming perfume ingredients.

In the perfume art, some auxiliary materials having no odor, or a low odor, are used, e.g., as solvents, diluents, extenders or fixatives. Non-limiting examples of these materials are ethyl alcohol, carbitol, dipropylene glycol, diethyl phthalate, triethyl citrate, isopropyl myristate, and benzyl benzoate. These materials are used for, e.g., solubilize or diluting some solid or viscous perfume ingredients to, e.g., improve handling and/or formulating. These materials are useful in the blooming perfume compositions, but are not counted in the calculation of the limits for the definition/formulation of the blooming perfume compositions of the present invention.

Non-blooming perfume ingredients are those having a B.P. of more than about 260° C. Table 3 gives some non-limiting examples of non-blooming perfume ingredients that have a ClogP of less than about 3. In certain automatic dishwashing detergent compositions, some non-blooming perfume ingredients can be used in small amounts, e.g., to improve overall perfume odor.

The blooming perfume compositions of present invention preferably also comprise from about 1% to about 30%, preferably from about 2% to about 30%, more preferably from about 3% to about 25%, of non-blooming perfume ingredients having a B.P. of more than about 260° C. and having a ClogP of at least about 3. These ingredients are particularly effective at masking base odors from the diacyl peroxide-bleaching agent. When used at the low levels herein, an improved blooming perfume composition is obtained that betters masks base odors while still minimizing residual perfume on dishes and tableware. Table 4 provides some non-limiting examples of such base masking perfume ingredients.

In the following tables, measured boiling points are taken from the above-mentioned sources.

Estimated boiling points are an average of those determined by the above-mentioned computer programs.

The predicted ClogP at 25° C. was determined by the following computer program:

Panoma MedChem/Daylight ClogP V. 4.42

TABLE 1

Examples of Blooming Perfume Ingredients

| Ingredient | ClogP (Pred.) | Boiling Pt. (Meas.) | Boiling Pt. (Pred.) |
|---|---|---|---|
| Allo-ocimene | 4.36 | | 195 |
| Allyl cyclohexanepropionate | 3.94 | | 252 |
| Allyl heptanoate | 3.40 | | 209 |
| trans-Anethole | 3.31 | 232 | |
| Benzyl butyrate | 3.02 | 240 | |
| Camphene | 4.18 | 160 | |
| Cadinene | 7.27 | | 252 |
| Carvacrol | 3.40 | 238 | |
| cis-3-Hexenyl tiglate | 3.80 | | 225 |
| Citronellol | 3.25 | 223 | |
| Citronellyl acetate | 4.20 | 234 | |
| Citronellyl nitrile | 3.09 | 226 | |
| Citronellyl propionate | 4.73 | | 257 |
| Cyclohexylethyl acetate | 3.36 | 222 | |
| Decyl Aldehyde (Capraldehyde) | 4.01 | 208 | |
| Delta Damascone | 3.62 | | 256 |
| Dihydromyrcenol | 3.03 | 192 | |
| Dihydromyrcenyl acetate | 3.98 | | 221 |
| 3,7-Dimethyl-1-octanol | 3.74 | 205 | |
| Diphenyloxide | 4.24 | 259 | |
| Fenchyl Acetate (1,3,3-Trimethyl-2-norbornanyl acetate) | 3.53 | | 234 |
| Geranyl acetate | 3.72 | 233 | |
| Geranyl formate | 3.27 | | 231 |
| Geranyl nitrile | 3.25 | 228 | |
| cis-3-Hexenyl isobutyrate | 3.27 | | 204 |
| Hexyl Neopentanoate | 4.06 | | 213 |
| Hexyl tiglate | 4.28 | | 221 |
| alpha-Ionone | 3.71 | 237 | |
| Ionone Beta | 3.77 | | 239 |
| Isobornyl acetate | 3.53 | 238 | |
| Isobutyl benzoate | 3.57 | 242 | |
| Isononyl acetate | 4.28 | | 220 |
| Isononyl alcohol (3,5,5-Trimethyl-1-hexanol) | 3.08 | 194 | |
| Isopulegyl acetate | 3.70 | | 243 |
| Lauraldehyde | 5.07 | 250 | |
| Linalyl acetate | 3.50 | | 230 |
| Lorysia | 4.06 | | 236 |
| D-limonene | 4.35 | | 177 |
| Lymolene | 3.03 | | 198 |
| (-)-L-Menthyl acetate | 4.18 | 227 | |
| Methyl Chavicol (Estragole) | 3.13 | 216 | |
| Methyl n-nonyl acetaldehyde | 4.85 | 247 | |
| Methyl octyl acetaldehyde | 4.32 | | 224 |
| beta-Myrcene | 4.33 | | 165 |
| Neryl acetate | 3.72 | 236 | |
| Nonyl acetate | 4.41 | 229 | |

TABLE 1-continued

Examples of Blooming Perfume Ingredients

| Ingredient | ClogP (Pred.) | Boiling Pt. (Meas.) | Boiling Pt. (Pred.) |
|---|---|---|---|
| Nonaldehyde | 3.48 | 191 | |
| Para-Cymene | 4.07 | 173 | |
| alpha-Pinene | 4.18 | 156 | |
| beta-Pinene | 4.18 | 166 | |
| alpha-Terpinene | 4.41 | 175 | |
| gamma-Terpinene | 4.35 | 183 | |
| Terpineolene | 4.35 | | 172 |
| Alpha-Terpinyl acetate | 3.58 | 220 | |
| Tetrahydrolinalool | 3.52 | 202 | |
| Tetrahydromyrcenol | 3.52 | 195 | |
| Undecavertol | 3.69 | | 235 |
| 2-Undecenal | 4.22 | | 235 |
| Verdox (o-t-Butylcyclohexyl acetate) | 4.06 | | 239 |
| Vertenex (4-tert.Butylcyclohexyl acetate) | 4.06 | | 237 |

TABLE 2

Examples of "Delayed Blooming" Perfume Ingredients

| Ingredient | ClogP (Pred.) | Boiling Pt. (Meas.) | Boiling Pt. (Pred.) |
|---|---|---|---|
| Allyl Amyl Glycolate | 2.38 | | 218 |
| Allyl caproate | 2.87 | 186 | |
| Amyl acetate (n-Pentyl acetate) | 2.30 | 147 | |
| Amyl Propionate | 2.83 | 169 | |
| p-Anisaldehyde | 1.78 | 249 | |
| Anisic Aldehyde | 1.78 | | 220 |
| Anisole | 2.06 | 154 | |
| Benzaldehyde (Benzenecarboxaldehyde) | 1.50 | 179 | |
| Benzyl acetate | 1.96 | 211 | |
| Benzylacetone | 1.74 | 234 | |
| Benzyl alcohol | 1.10 | 205 | |
| Benzyl formate | 1.50 | 203 | |
| Benzyl propionate | 2.49 | 221 | |
| beta-gamma-Hexenol (2-Hexen-1-ol) | 1.40 | | 164 |
| (+)-Camphor | 2.18 | 207 | |
| (+)-Carvone | 2.01 | 231 | |
| L-Carvone | 2.01 | | 230 |
| Cinnamic alcohol | 1.41 | | 258 |
| Cinnamyl formate | 1.91 | 252 | |
| cis-Jasmone | 2.64 | | 253 |
| cis-3-Hexenyl acetate | 2.34 | | 175 |
| Citral (Neral) | 2.95 | 208 | |
| Cumic alcohol | 2.53 | 249 | |
| Cuminaldehyde | 2.92 | 235 | |
| Cyclal (2,4-Dimethyl-3-cyclohexene-1-carboxaldehyde) | 2.36 | | 203 |
| Dimethyl benzyl carbinol | 1.89 | 215 | |
| Dimethyl benzyl carbinyl acetate | 2.84 | | 248 |
| Ethyl acetate | 0.71 | 77 | |
| Ethyl acetoacetate | 0.33 | 181 | |
| Ethyl amyl ketone | 2.44 | 167 | |
| Ethyl benzoate | 2.64 | 215 | |
| Ethyl butanoate | 1.77 | 121 | |
| Ethyl Butyrate | 1.77 | | 124 |
| Ethyl-2-methyl butryrate | 2.08 | | 131 |
| Ethyl-2-methyl pentanoate | 2.69 | | 159 |
| 3-Nonanone (Ethyl hexyl ketone) | 2.97 | 187 | |
| Ethyl Maltol | 0.68 | | 248 |
| Ethyl phenylacetate | 2.35 | 228 | |
| Eucalyptol | 2.76 | 176 | |
| Eugenol | 2.40 | 253 | |
| Fenchyl alcohol | 2.58 | 199 | |
| Flor Acetate (Tricyclodecenyl acetate) | 2.36 | | 233 |
| Frutene (Tricyclodecenyl propionate) | 2.89 | | 250 |
| gamma-Nonalactone | 2.77 | 243 | |
| trans-Geraniol | 2.77 | 230 | |
| cis-3-Hexen-1-ol/Leaf Alcohol | 1.40 | 156 | |
| Hexyl acetate | 2.83 | 171 | |

TABLE 2-continued

Examples of "Delayed Blooming" Perfume Ingredients

| Ingredient | ClogP (Pred.) | Boiling Pt. (Meas.) | Boiling Pt. (Pred.) |
|---|---|---|---|
| Hexyl formate | 2.38 | 155 | |
| Hydratopic alcohol | 1.58 | | 233 |
| Hydroxycitronellal | 1.54 | 241 | |
| Indole (2,3-Benzopyrrole) | 2.13 | 254 | |
| Isoamyl alcohol | 1.22 | 131 | |
| Isopropyl phenylacetate | 2.66 | | 237 |
| Isopulegol | 2.75 | | 231 |
| Isoquinoline (Benzopyridine) | 1.82 | 243 | |
| Ligustral (2,4-Dimethyl-3-Cyclohexene-1-carboxaldehyde) | 2.36 | | 204 |
| Linalool | 2.55 | 193 | |
| Linalool oxide | 1.45 | | 223 |
| Menthone | 2.83 | | 214 |
| 4-Methylacetophenone | 2.08 | 226 | |
| Methyl pentyl ketone | 1.91 | 151 | |
| Methyl anthranilate | 2.02 | 256 | |
| Methyl benzoate | 2.11 | 199 | |
| Methyl Phenyl Carbinyl Acetate (alpha-Methylbenzyl acetate) | 2.27 | | 216 |
| Methyl Eugenol (Eugenyl methyl ether) | 2.67 | 254 | |
| Methyl Heptenone (6-Methyl-5-hepten-2-one) | 1.82 | 173 | |
| Methyl Heptine Carbonate (Methyl 2-octynoate) | 2.57 | 218 | |
| Methyl Heptyl ketone | 2.97 | 195 | |
| Methyl Hexyl ketone | 2.44 | 173 | |
| Methyl pamplemousse (1,1-dimethoxy-2,2,5-trimethyl-4-hexene) | 2.70 | | 194 |
| Methyl salicylate | 2.45 | 223 | |
| Dimethyl anthranilate | 2.16 | 255 | |
| Nerol | 2.77 | 225 | |
| delta-Nonalactone | 2.80 | | 226 |
| gamma-Octalactone | 2.24 | 256 | |
| 2-Octanol | 2.72 | 180 | |
| Octyl Aldehyde (Caprylic aldehyde) | 2.95 | 167 | |
| p-Cresol | 1.97 | 202 | |
| p-Cresyl methyl ether | 2.56 | 175 | |
| Acetanisole | 1.80 | 258 | |
| 2-Phenoxyethanol | 1.19 | 245 | |
| Phenylacetaldehyde | 1.78 | 195 | |
| 2-Phenylethyl acetate | 2.13 | 235 | |
| Phenylethyl alcohol | 1.18 | 218 | |
| Phenyl Ethyl dimethyl Carbinol (Benzyl-tert-butanol) | 2.42 | | 257 |
| Prenyl acetate | 1.68 | | 150 |
| Propyl butanoate | 2.30 | 143 | |
| (+)-Pulegone | 2.50 | 224 | |
| Rose oxide (Methyl Iso Butenyl Tetrahydro Pyran) | 2.90 | | 197 |
| Safrole | 2.57 | 235 | |
| Stemone (5-Methyl-3-heptanone-oxime) | 2.64 | | 205 |
| 4-Terpinenol | 2.75 | 211 | |
| Alpha Terpineol | 2.75 | | 222 |
| Triplal (2,4-Dimethyl-3-Cyclohexene-1-carboxaldehyde) | 2.36 | | 204 |
| Veratrole (1,2-Dimethoxybenzene) | 1.60 | 206 | |
| Violiff | 2.77 | | 238 |
| Viridine (Phenylacetaldehyde dimethyl acetal) | 1.29 | 220 | |

TABLE 3

Examples of "Non-Blooming" Perfume Ingredients Having ClogP of Less Than About 3

| Ingredient | ClogP (Pred.) | Boiling Pt. (Meas.) | Boiling Pt. (Pred.) |
|---|---|---|---|
| Coumarin | 1.41 | 302 | |
| Ethyl methylphenylglycidate | 2.71 | 274 | |
| Ethyl Vanillin | 1.80 | 285 | |

TABLE 3-continued

Examples of "Non-Blooming" Perfume Ingredients Having ClogP of Less Than About 3

| Ingredient | ClogP (Pred.) | Boiling Pt. (Meas.) | Boiling Pt. (Pred.) |
|---|---|---|---|
| Isoeugenol | 2.58 | 266 | |
| Methyl cinnamate | 2.47 | 262 | |
| Methyl dihydro jasmonate | 2.42 | | 314 |
| Methyl beta-naphthyl ketone | 2.76 | 302 | |
| Para Hydroxy Phenyl Butanone (Raspberry ketone) | 1.07 | | 301 |
| Phenoxy ethyl isobutyrate | 2.92 | | 277 |
| Vanillin | 1.28 | 285 | |

TABLE 4

Examples of "Base Masking" Perfume Ingredients

| Ingredient | ClogP (Pred.) | Boiling Pt. (Meas.) | Boiling Pt. (Pred.) |
|---|---|---|---|
| (Ambrettolide) Oxacycloheptadec-10-en-2-one | 6.36 | | 352 |
| (Amyl benzoate) n-Pentyl benzoate | 4.23 | | 263 |
| Isoamyl cinnamate | 4.45 | | 300 |
| alpha-Amylcinnamaldehyde | 4.32 | 289 | |
| alpha-Amylcinnamaldehyde dimethyl acetal | 4.03 | | 320 |
| (iso-Amyl Salicylate) isopentyl salicylate | 4.43 | 277 | |
| (Aurantiol) Methyl anthranilate/hydroxycitronellal Schiff base | 4.22 | | 413 |
| Benzophenone | 3.18 | 305 | |
| Benzyl salicylate | 4.21 | 320 | |
| beta-Caryophyllene | 6.45 | | 263 |
| Cedrol | 4.53 | | 274 |
| Cedryl acetate | 5.48 | | 289 |
| Cinnamyl cinnamate | 4.64 | | 387 |
| Citrathal | 3.93 | | 262 |
| Citronellyl isobutyrate | 5.04 | | 266 |
| Clonal | 4.90 | | 267 |
| Cyclohexyl salicylate | 4.48 | | 327 |
| Cyclamen aldehyde | 3.46 | | 271 |
| Cyclabute | 3.41 | | 275 |
| delta-Dodecalactone | 4.39 | | 279 |
| (Dihydro Isojasmonate) Methyl 2-hexyl-3-oxo-cyclopentanecarboxylate | 3.09 | | 314 |
| Diphenylmethane | 4.06 | 265 | |
| Ethylene brassylate | 4.62 | | 390 |
| Ethyl undecylenate | 4.99 | 261 | |
| Florhydral | 3.55 | | 277 |
| Iso E Super | 4.85 | | 306 |
| (Exaltolide) Pentadecanolide | 6.29 | | 338 |
| (Galaxolide) 4,6,6,7,8,8-Hexamethyl-1,3,4,6,7,8-hexahydro-cyclopenta(G)-2-benzopyran | 6.06 | | 335 |
| gamma-Methyl Ionone (alpha-Isomethylionone) | 4.02 | | 278 |
| Geranyl isobutyrate | 5.00 | | 295 |
| Habanolide | 6.29 | | 330 |
| Hexadecanolide | 6.85 | | 352 |
| cis-3-Hexenyl salicylate | 4.61 | | 323 |
| aipha-Hexylcinnamaldehyde | 4.85 | | 334 |
| n-Hexyl salicylate | 5.09 | | 318 |
| Hexadecanolide | 6.85 | | 352 |
| alpha-Irone | 4.23 | | 279 |
| 6-Isobutylquinoline | 3.99 | | 294 |
| Lilial (p-tert.Butyl-alpha-methyldihydrocinnamic aldehyde, PT Bucinol) | 3.86 | | 282 |
| Linalyl benzoate | 5.42 | | 325 |
| (2-Methoxy Naphthalene) beta-Naphthyl methyl ether | 3.24 | 274 | |

TABLE 4-continued

Examples of "Base Masking" Perfume Ingredients

| Ingredient | ClogP (Pred.) | Boiling Pt. (Meas.) | Boiling Pt. (Pred.) |
|---|---|---|---|
| Nectaryl | 4.43 | | 317 |
| Neobutenone | 3.63 | | 266 |
| 10-Oxahexadecanolide | 4.38 | | 355 |
| Patchouli alcohol | 4.53 | | 317 |
| (Phantolide) 5-Acetyl-1,1,2,3,3,6-hexamethylindan | 5.69 | | 333 |
| Phenethyl benzoate | 4.06 | | 335 |
| Phenethyl phenylacetate | 3.77 | | 350 |
| Phenyl Hexanol (3-Methyl-5-phenyl-1-pentanol) | 3.17 | | 296 |
| Tonalid (7-Acetyl-1,1,3,4,4,6-hexamethyltetralin) | 6.25 | | 344 |
| delta-Undecalactone | 3.86 | | 262 |
| gamma-Undecalactone | 3.83 | 286 | |
| Vertinert Acetate | 5.47 | | 332 |

Perfumes suitable for use in automatic dishwashing detergent compositions can be formulated from known fragrance ingredients, and for purposes of enhancing environmental compatibility, the perfume is preferably substantially free of halogenated fragrance materials and nitromusks.

The compositions of this invention may contain an effective amount of various moisture-activated encapsulated perfume particles, as an optional ingredient. These are described in detail in U.S. Patent 6,143,707, Trinh et al., incorporated herein by reference. The encapsulated particles act as protective carriers and reduce the loss of perfume prior to use. Such materials include, for example, cyclodextrin/perfume inclusion complexes, polysaccharide cellular matrix perfume microcapsules, and the like. Encapsulation of perfume minimizes the diffusion and loss of the volatile blooming perfume ingredients. Perfume is released when the materials are wetted, to provide a pleasant odor signal in use. Especially preferred are cyclodextrin inclusion complexes.

The optional water-activated protective perfume carriers allow the use of lower levels of perfume in the detergent compositions herein because of the reduced loss of the perfume during manufacturing and use. Due to the minimal loss of the volatile ingredients in the blooming perfume compositions, perfume compositions that incorporate water activated protective perfume carrier can contain less blooming perfume ingredients than those used in the free, unencapsulated form. The encapsulated and/or complexed perfume compositions typically contain at least about 20%, preferably at least about 30%, and more preferably at least about 40%, blooming perfume ingredients. Optionally, but preferably, compositions that contain encapsulated and/or complexed perfume also comprise free perfume in order to provide consumers with a positive scent signal before the composition is used.

Bleaching Agent

The composition of the present invention generally contain from about 0.1% to about 10%, preferably from about 0.3% to about 7%, more preferably from about 0.5% to about 5%, and most preferably from about 0.7% to about 3%, of diacyl peroxide of the general formula:

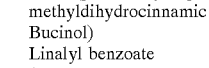

RC(O)OO(O)CR wherein each R, independently, is a hydrocarbyl group. Each R can be an alkyl, aryl, heterocyclic, imino, amino, or floro group. Preferably no more than one R is a hydrocarbyl chain of longer than ten carbon atoms, more preferably at least one has an aromatic nucleus.

The preferred diacyl peroxides have a melting point greater than about 30° C., preferably greater than about 50° C., most preferably above 70° C.

The diacyl peroxide should be present in the form of insoluble or relatively insoluble particles having a particle size of from about 0.1 to about 30 microns, preferably from about 0.5 to about 20 microns, more preferably from about 1 to about 10 microns. Preferably, at least about 25%, more preferably at least about 50%, even more preferably at least about 75%, most preferably at least about 90%, of the particles are smaller than 10 microns, preferably smaller than 6 microns. Compositions having larger size diacyl peroxide particles are more difficult to stabilize in the preferred liquid or gel compositions of the invention, particularly during storage for longer periods of time, and often result in increased deposition and filming on dishware during use in automatic dishwashing machines. Diacyl peroxides within the above particle size range have also been found to provide better stain removal from plastic dishware, while minimizing undesirable deposition and filming, than larger diacyl peroxide particles. The preferred diacyl peroxide particle size thus allows the formulator to obtain good stain removal with a low level of diacyl peroxide, which reduces deposition and filming. Conversely, as diacyl peroxide particle size increases, more diacyl peroxide is needed for good stain removal, which increases deposition on surfaces encountered during the dishwashing process.

Examples of suitable diacyl peroxides include dibenzoyl peroxide, benzoyl lauryl peroxide, benzoyl succinyl peroxide, di-(2-methybenzoyl) peroxide, diphthaloyl peroxide, and mixtures thereof. Preferably, the diacyl peroxide is selected from dibenzoyl peroxide, dicumyl peroxide, diphthaloyl peroxide, and mixtures thereof. A particulary preferred diacyl peroxide is dibenzoyl peroxide.

Optional Ingredients

Preferred liquid or gel compositions of the present invention contain a viscoelastic, thixotropic thickening agent. The thickening agent is used at a level of from about 0.1% to about 5%, preferably from about 0.2% to about 3%, most preferably from about 0.3% to about 2%, by weight of the composition. The type and level of thickener should be selected to provide the desired product thickness and stability, while minimizing undesired properties such as deposition and filming on plastic surfaces.

Preferably, the thickening agent is a polymer with a molecular weight of at least about 500,000, preferably from about 500,000 to 10,000,000. The polymeric thickening agent can be, but is not limited to, a cross-linked polycarboxylate polymer.

The cross-linked polycarboxylate polymer is preferably a carboxyvinyl polymer. Such compounds are disclosed in U.S. Pat. No. 2,798,053, Brown, issued on Jul. 2, 1957, incorporated herein by reference. Methods for making carboxyvinyl polymers are also disclosed in Brown. Carboxyvinyl polymers are substantially insoluble in liquid, volatile organic hydrocarbons and are dimensionally stable on exposure to air.

Various carboxyvinyl polymers, homopolymers and copolymers are commercially available from B. F. Goodrich Company, New York, N.Y., under the trade name Carbopol®. These polymers are also known as carbomers or polyacrylic acids. Carboxyvinyl polymers useful in formulations of the present invention include Carbopol 910 having a molecular weight of about 750,000, Carbopol 941 having a molecular weight of about 1,250,000, and Carbopols 934 and 940 having molecular weights of about 3,000,000 and 4,000,000, respectively. More preferred are the series of Carbopols, which use ethyl acetate and cyclohexane in the manufacturing process, for example, Carbopol 981, 984, 980, and 1382, and their easy-to-disperse equivalents such as Carbopol ETD2001, ETD2050 and ETD2020.

Preferred polycarboxylate polymers of the invention are non-linear, water-dispersible, polyacrylic acid cross-linked with a polyalkenyl polyether and having a molecular weight of at lease 750,000, preferably from about 750,000 to about 4,000,000.

Highly preferred examples of these polycarboxylate polymers for use in the present invention are Sokalan PHC-25®, a polyacrylic acid available from BASF Corporation, the Carbopol series resins available from B. F. Goodrich, and the Polygel series available from 3-V Chemical Corporation. Mixtures of polycarboxylate polymers as herein described may also be used.

The polycarboxylate polymer-thickening agent can be used alone or with inorganic clays (e.g. aluminum silicate, bentonite, fumed silica). The preferred clay-thickening agent can be either naturally occurring or synthetic. A preferred synthetic clay is the one disclosed in the U.S. Pat. No. 3,843,598, incorporated herein by reference. Naturally occurring clays include some smectite and attapulgite clays as disclosed in U.S. Pat. No. 4,824,590, incorporated herein by reference.

Other types of thickeners, which can be used in this composition, include natural gums, such as xanthan gum, locust bean gum, guar gum, and the like. Semi-synthetic thickeners such as the cellulosic type thickeners: hydroxyethyl and hydroxymethyl cellulose (ETHOCEL and METHOCEL® available from Dow Chemical) can also be used. Mixtures of polymeric thickening agents, semi-synthetic, and natural thickeners herein described may also be used.

Preferred liquid or gel compositions of the present invention contain from about 40% to about 99%, preferably from about 60% to about 99%, more preferably from about 80% to about 99%, and most preferably from about 90% to about 99%, by weight of water.

The compositions may also contain minor amounts of solvents in which the diacyl peroxide will not dissolve. Suitable solvents useful herein are glycerol, dimethyl siloxanes, sorbitol, and mixtures thereof. If present, such solvents represent less than about 20%, preferably less than about 10%, most preferably less than about 5%, by weight of the composition.

The compositions herein should not contain significant amounts of solvents capable of dissolving the diacyl peroxides herein. Examples of such solvents are N-alkyl pyrrolidones, such as N-ethyl pyrrolidone, diactone alcohol, alkyl ethers, cyclic alkyl ketones, and mixtures thereof. Amines, ethers and low molecular weight primary and secondary alcohols (about $C_1$–$C_6$) also are preferably not present, since it is believed that they may introduce stability problems. Preferably, the compositions herein contain no more than about 5% by weight of such solvents. More preferably, the compositions contain no more than about 2% by weight of such solvents. Most preferably, they are substantially free of such solvents.

Preferred liquid or gel compositions herein have a pH, measured at a concentration of 1% by weight in water, of from 2 to about 10, preferably from about 3 to about 9, more preferably from about 4 to about 8, and most preferably from about 5 to about 7. At higher pHs, the diacyl peroxide particles are degraded and stain removal performance is reduced, particularly in the presence of agents that solubilize the diacyl peroxide such as surfactants.

The compositions may thus comprise a pH-adjusting component selected from water-soluble alkaline inorganic salts and water-soluble organic or inorganic builders. Preferred pH-adjusting components are selected from the group consisting of: sodium/potassium carbonate or sesquicarbonate; sodium/potassium silicate, preferably hydrous sodium silicate having $SiO_2$:$Na_2O$ ratio of from about 1.:1 to about 2:1; sodium/potassium citrate; citric acid; sodium/potassium bicarbonate; sodium/potassium borate, preferably borax; and sodium/potassium hydroxide; and mixtures thereof.

Alkali metal silicates also provide protection against corrosion of metals and inhibit corrosion of glasswares and chinawares, as described in EP 717,102, published Jun. 19, 1996, incorporated herein by reference. However, the silicate type and level must be selected such that the pH stays within the desired pH range.

The pH-adjusting system can be complemented (e.g., for improved sequestration in hard water) by other optional detergency builder salts selected from phosphate or non-phosphate detergency builders known in the art, which include the various water-soluble, alkali metal, ammonium or substituted ammonium borates, hydroxysulfonates, polyacetates, and polycarboxylates. Preferred is the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S-form); nitrilotriacetic acid, tartrate monosuccinic acid, tartrate disuccinic acid, oxydisuccinic acid, carboxymethyloxysuccinic acid, and mellitic acid, and sodium benzene polycarboxylate salts. Water insoluble builder like zeolites can also be used as builders.

The compositions of the present invention may also contain various other ingredients known for use in bleaching compositions, particularly compositions for use in automatic dishwashing machines. Generally, the compositions herein contain from about 0.01% to about 20%, preferably from about 0.1% to about 15%, more preferably from about 0.5% to about 10%, by weight, of such optional ingredients.

Heavy metal ion sequestrants (chelants) are useful components herein. These components may also have calcium and magnesium chelation capacity, but preferentially bind heavy metal ions such as iron, manganese and copper. If present, the heavy metal ion sequestrant is preferably used at a level of from 0.005% to 5%, more preferably from 0.05% to 1%, by weight of the composition.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water-soluble. The molar ratio of said counter cation to the heavy metal ion sequestrant is preferably at least 1:1.

Suitable heavy metal ion sequestrants for use herein include the organo aminophosphonates, such as the amino alkylene poly (alkylene phosphonates) and nitrilo trimethylene phosphonates. Preferred organo aminophosphonates are diethylene triamine penta (methylene phosphonate) and hexamethylene diamine tetra (methylene phosphonate).

Other suitable heavy metal ion sequestrants for use herein include nitrilotriacetic acid and polyaminocarboxylic acids such as ethylenediaminotetracetic acid, ethylenetriamine pentacetic acid, or ethylenediamine disuccinic acid. Especially preferred is ethylenediamine-N,N'-disuccinic acid (EDDS), most preferably present in the form of its S,S isomer, which is preferred for its biodegradability profile.

Still other suitable heavy metal ion sequestrants for use herein are iminodiacetic acid derivatives such as 20-hydroxyethyl diacetic acid or glyceryl imino diacetic acid.

A preferred chelant is an organo diphosphonic acid or one of its salts/complexes. The organo diphosphonic acid is preferably a $C_1$–$C_4$ diphosphonic acid, more preferably a C2 diphosphonic acid, such as ethylene diphosphonic acid, or most preferably ethane 1-hydroxy-1,1-diphosphonic acid (HEDP).

The compositions of the present invention can additionally contain an additional amount of oxygen bleach or chlorine bleach.

The oxygen bleach should be sufficient to provide from 0.01% to about 8%, preferably from about 0.1% to about 5.0%, more preferably from about 0.3% to about 4.0%, most preferably from about 0.8% to about 3% of available oxygen (AvO) by weight of the composition.

The peroxygen bleaching systems useful herein are those capable of yielding hydrogen peroxide in an aqueous liquor. These compounds include, but are not limited to, hydrogen peroxide, the alkali metal peroxides, organic peroxide bleaching compounds such as urea peroxide and inorganic persalt bleaching compounds such as the alkali metal perborates, percarbonates, perphosphates, and the like. Mixtures of two or more such bleaching compounds can also be used.

Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate. Percarbonate is especially preferred because of environmental issues associated with boron.

Suitable oxygen-type bleaches are further described in U.S. Pat. No. 4,412,934 (Chung et al), issued Nov. 1, 1983, and peroxyacid bleaches described in European Patent Application 033,259, Sagel et al, published Sep. 13, 1989, both incorporated herein by reference, can be used.

The optional peroxygen bleach component may be formulated with an activator (peracid precursor). The activator is present at levels of from about 0.01% to about 5%, preferably from about 0.1% to about 4%, more preferably from about 0.5% to about 2%, by weight of the composition. Preferred activators are selected from the group consisting of benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenylbenzoate (PhBz), decanoyloxybenzenesulphonate ($C_{10}$-OBS), benzolyvalerolactam (BZVL), octanoyloxybenzenesulphonate ($C_8$-OBS), perhydrolyzable esters and mixtures thereof, most preferably benzoylcaprolactam and benzolyvalerolactam. Preferred bleach activators are those described in U.S. Pat. Nos. 5,130,045, Mitchell et al, and 4,412,934, Chung et al, and in U.S. Pat. Nos. 5,998,350 and 5686,401, and EP 699,230 all of which are incorporated herein by reference.

The mole ratio of peroxygen bleaching compound (as AvO) to bleach activator in the present invention generally ranges from at least 1:1, preferably from about 20:1 to about 1:1, more preferably from about 10:1 to about 3:1.

The compositions of the present invention may also contain a bleach catalyst material, such as disclosed in U.S.

Pat. Nos. 4,430,243; 5,246,621; 5,244,594; 4,246,612; 5,227,084; 5,194,416; 5,114,606; and 5,114,611.

Other bleach catalysts are described, for example, in European patent application publication no. 408,131 (cobalt complex catalysts), European patent application publication nos. 384,503 and 306,089 (metallo-porphyrin catalysts), U.S. 4,728,455 (manganese/multidentate ligand catalyst), U.S. Pat. No. 4,711,748 and European patent application publication no. 224,952 (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. Specification 2,054,019 (cobalt chelant catalyst), Canadian 866, 191 (transition metal-containing salts), U.S. Pat. No. 4,430, 243 (chelants with manganese cations and non-catalytic metal cations), and U.S. Pat. No. 4,728,455 (manganese gluconate catalysts).

Compositions of the present invention can comprise detergent surfactants, provided the surfactant type and level are selected to maintain the desired diacyl peroxide particle size. Low foaming nonionic surfactants (LFNIs) are preferred, and can be present in amounts from 0.1% to about 15% by weight, preferably from about 0.25% to about 10%, most preferably from about 0.5% to about 5%. LFNIs are most typically used to provide the improved water-sheeting action (especially from glass), which they confer to the product. They also encompass non-silicone, phosphate or nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene reverse block polymers. The PO/EO/PO polymer-type surfactants are well known to have foam suppressing or defoaming action, especially in relation to common food soil ingredients such as egg.

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Preferred compositions herein containing the LFNI make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds that meet the requirements described herein before include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12}$-$_{18}$ aliphatic alcohols, do not generally provide satisfactory suds control in the instant compositions. Certain of the block polymer surfactant compounds designated PLURONIC® and TETRONIC® by the BASF-Wyandotte Corp., Wyandotte, Mich., are suitable in compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs, which may also be used, include a $C_{18}$ alcohol polyethoxylate, having a degree of ethoxylation of about 8, commercially available SLF18 from BASF, and any biodegradable LFNI having the cloud point properties discussed herein above.

The compositions herein can additionally contain an anionic surfactant, in an amount from 0 to about 5%, preferably from about 0.1% to about 3%, more preferably from about 0.25% to about 1%, by weight of the composition.

Suitable anionic surfactants include branched or linear alkyl sulfates and sulfonates. These may contain from about 8 to about 20 carbon atoms. Other anionic surfactants include the alkyl benzene sulfonates containing from about 6 to about 13 carbon atoms in the alkyl group, and mono- and/or dialkyl phenyl oxide mono- and/or di-sulfonates wherein the alkyl groups contain from about 6 to about 16 carbon atoms. All of these anionic co-surfactants are used as stable salts, preferably sodium and/or potassium.

Preferred anionic surfactants include sulfobetaines, betaines, alkyl (polyethoxy) sulfates (AES) and alkyl (polyethoxy) carboxylates, which are usually high sudsing. Optional anionic surfactants are further illustrated in published British Patent Application No. 2,116,199A; U.S. Pat. No. 4,005,027, Hartman; U.S. Pat. No. 4,116,851, Rupe et al; and U.S. Pat. No. 4,116,849, Leikhim, all of which are incorporated herein by reference.

The preferred anionic surfactants of the invention in combination with the other components of the composition provide excellent cleaning and outstanding performance from the standpoints of residual spotting and filming. However, many of these co-surfactants may also be high sudsing thereby requiring the addition of LFNI, LFNI in combination with alternate suds suppressors as further disclosed hereinafter, or alternate suds suppressors without conventional LFNI components.

The compositions of the invention can optionally contain an alkyl phosphate ester suds suppressor, a silicone suds suppressor, or combinations thereof. Levels in general are from 0% to about 3%, preferably from about 0.001% to about 2%. Typical levels tend to be low, e.g., from about 0.01% to about 1% when a silicone suds suppressor is used. Preferred non-phosphate compositions omit the phosphate ester component entirely.

It is preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Compositions herein may additionally contain a dispersant polymer. Dispersant polymers are generally compatible with the diacyl peroxide (i.e. do not solubilize the diacyl peroxide) and typically are used at levels up to about 10%, preferably from about 0.1% to about 6%, more preferably from about 0.2% to about 4% by weight of the composition. Dispersant polymers are useful for improved filming performance of the present compositions, especially in higher pH embodiments, such as those in which pH exceeds about 9.5. Particularly preferred are polymers, which inhibit the deposition of calcium carbonate or magnesium silicate on dishware.

Dispersant polymers suitable for use herein are illustrated by the film-forming polymers described in U.S. Pat. No. 4,379,080 (Murphy), issued Apr. 5, 1983, incorporated herein by reference.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 1000 to about 250,000, and most preferably, from about 1000 to about 5,000.

Other suitable dispersant polymers include those disclosed in U.S. Pat. No. 3,308,067 issued Mar. 7, 1967, to Diehl, incorporated herein by reference. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. Is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[(C($R^2$)C($R^1$)(C(O)O$R^3$)]—wherein the incomplete valencies inside the square braces are hydrogen and at least one of the substituents $R^1$, $R^2$ or $R^3$, preferably $R^1$ or $R^2$, is a 1 to 4 carbon alkyl or hydroxyalkyl group, $R^1$ or $R^2$ can be a hydrogen and $R^3$ can be a hydrogen or alkali metal salt. Most preferred is a substituted acrylic monomer wherein $R^1$ is methyl, $R^2$ is hydrogen and $R^3$ is sodium.

The low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of 3500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535, both incorporated herein by reference.

Preferred polymers also include polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982, incorporated herein by reference.

Other dispersant polymers useful herein include the polyethylene glycols and polypropylene glycols having a molecular weight of from about 950 to about 30,000, which can be obtained from the Dow Chemical Company of Midland, Mich. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point. The polyethylene, polypropylene and mixed glycols are referred to using the formula HO(CH2CH2O)m(CH2CH(CH3)O)n(CH(CH3)CH2O)OH wherein m, n, and o are integers satisfying the molecular weight and temperature requirements given above.

The present compositions may also contain corrosion inhibitor. Such corrosion inhibitors are preferred components of machine dishwashing compositions in accord with the invention, and are preferably incorporated at a level of from 0.05% to 10%, more preferably from 0.1% to 5% by weight of the total composition. Suitable corrosion inhibitors include paraffin oil, typically a predominantly branched aliphatic hydrocarbon having a number of carbon atoms in the range of from 20 to 50. Preferred paraffin oil is selected from the predominantly branched $C_{25-45}$ species with a ratio of cyclic to noncyclic hydrocarbons of about 32:68. A paraffin oil meeting these characteristics is sold by Wintershall, Salzbergen, Germany, under the trade name WINOG 70.

Other suitable corrosion inhibitor compounds include benzotriazole and any derivatives thereof, mercaptans and diols, especially mercaptans with 4 to 20 carbon atoms including lauryl mercaptan, thiophenol, thionapthol, thionalide and thioanthranol. Also suitable are the $C_{12}$–$C_{20}$ fatty acids and hydroxy fatty acids, or their salts, especially aluminum tristearate. Phosphonated octa-decane and other anti-oxidants such as betahydroxytoluene (BHT) are also suitable.

Bleach-stable dyes (such as those disclosed in U.S. Pat. No. 4,714,562, Roselle et al, issued Dec. 22, 1987) can also be added to the present compositions in appropriate amounts.

Method for Cleaning

The present invention also encompasses a method for cleaning dishware in an automatic dishwashing machine, said method comprising contacting said dishware with an aqueous bath comprising the automatic dishwashing detergent composition herein. In a preferred embodiment, the method encompasses cleaning plastic dishware surfaces while minimizing deposition, comprising contacting said surfaces with an aqueous wash liquor comprising from about 10 ppm to about 300 ppm of the above diacyl peroxide particles having a particle size of from about 0.1 to about 30 microns. The wash liquor preferably has a pH of from about 2 to about 11, preferably from about 2 to about 10, for good cleaning performance.

The diacyl peroxide particles in the wash liquor preferably have a particle size from about 0.5 to about 20 microns, more preferably from about 1 to about 10 microns, for best stain removal, while minimizing filming due to deposition of larger diacyl peroxide particles. Filming can also increase if the diacyl peroxide particles are solubilized, or if the concentration of the diacyl peroxide in the wash liquor exceeds about 300 ppm. In a preferred embodiment, the aqueous wash liquor comprises from about 20 to about 250 ppm, more preferably from about 50 to about 200 ppm, most preferably from about 50 to about 150 ppm, of the diacyl peroxide particles.

For compositions herein intended for cleaning dishwashing machines, where deposition of diacyl peroxide particles and filming are not noticeable to consumers, it will be appreciated that larger diacyl peroxides particles and higher levels thereof may be used, and the optional cleaning ingredients herein may be preferred.

The aqueous wash liquor is formed by dispersing the bleaching composition herein in a dishwashing machine. In a preferred embodiment, the bleaching composition herein is a thixotropic gel that is dispensed from the main wash dispensing cup of the automatic dishwashing machine. This provides adequate contact time for the diacyl peroxide particles to bleach and remove stains from plastic surfaces during the washing process. In contrast, dosing during the pre-wash may not allow enough active bleaching species to survive until the main wash for optimum performance. Alternatively, thicker products may be formulated that release an adequate amount of diacyl peroxide particles during the washing process, even when dispensed at the beginning of the process. For example, a thickened product can be dispensed from a tube or bottle onto the door (including in an open dispensing cup) or bottom of the machine, or directly onto stained dishware in the machine. The dishwashing machine can then be operated, with or without a fully formulated, automatic dishwashing detergent composition added to one or both dispensing cups. The products of the present invention can also be dosed from a device placed inside the machine, so long as there is adequate contact time between the diacyl peroxide particles and the surfaces to be bleached. However, dosing of the diacyl peroxide in the final rinse generally provides insufficient contact time for optimum bleaching performance.

Additionally, a package for the bleaching composition herein preferably is substantially impermeable to water, carbon dioxide, and light. Plastic bottles, including refillable or recyclable types, as well as conventional barrier cartons or boxes are generally suitable. When ingredients are not highly compatible, e.g., mixtures of silicates and citric acid, it may further be desirable to coat at least one such ingredient with a low-foaming nonionic surfactant for protection. There are numerous waxy materials, which can readily be used to form suitable coated particles of any such otherwise incompatible components.

The package preferably contains instructions on the use of the composition herein with the package containing the composition or with other forms of advertising associated with the sale or use of the composition. The instructions may be included in any manner typically used by consumer product manufacturing or supply companies. Examples include providing instructions on a label attached to the container holding the composition; on a sheet either attached to the container or accompanying it when purchased; or in advertisements, demonstrations, and/or other written or oral instructions which may be connected to the purchase or use of the composition. The instructions should guide the user on the optimum methods for using the composition herein, including preferred dosage levels to obtain the desired concentration of diacyl peroxide in the wash liquor, and the preferred contact time and wash liquor temperature for optimum performance. For preferred compositions herein, intended for use in bleaching and removing stains from plastic dishware, the instructions direct the user to fill the main wash dispensing cup of the automatic dishwashing machine and run the machine without adding their regular detergent. Other preferred compositions of the invention can be dispensed from the pre-wash dispensing cup, or as otherwise described above, particularly if they contain sufficient thickener to provide for release of at least a portion of the diacyl peroxide in the main wash cycle. Such compositions are preferably used in conjunction with a regular automatic dishwashing detergent composition. Other preferred compositions herein intended for use as a machine cleaning product to de-stain and clean plastic surfaces on the interior of an automatic dishwashing machine preferably include instructions for use thereof. For example, the instructions may direct the user to fill the main wash dispensing cup with the product and run the machine empty.

The following examples illustrate the compositions of the present invention. These examples are not meant to limit or otherwise define the scope of the invention. All parts, percentages and ratios used herein are expressed as percent weight unless otherwise specified.

Perfume A and B are examples of preferred blooming perfume compositions of the invention. The perfumes also contain preferred blooming, delayed blooming, and base masking perfume ingredients herein.

PERFUME A

| Perfume Ingredients | Wt. % |
|---|---|
| Blooming Ingredients | |
| Citronellyl Acetate | 1.00 |
| Delta Damascone | 0.15 |
| Geranyl Nitrile | 5.25 |
| Ionone Beta | 12.00 |
| d-Limonene | 3.65 |
| Methyl Nonyl Acetaldehyde | 2.00 |
| Undecavertol | 0.25 |
| Verdox | 0.30 |
| Vertenex | 8.95 |
| | (33.55%) |
| Delayed Blooming Ingredients | |
| Allyl Amyl Glycolate | 1.30 |
| Benzyl Acetone | 1.00 |
| Beta Gamma Hexenol | 0.05 |

-continued

| | |
|---|---|
| Cis-3-Hexenyl Acetate | 0.20 |
| Dimethyl Benzyl Carbinyl Acetate | 2.50 |
| Ethyl Maltol | 0.05 |
| Ethyl-2-methyl Butyrate | 0.30 |
| Ethyl-2-methyl Pentanoate | 0.25 |
| Eucalyptol | 0.63 |
| Flor Acetate | 2.25 |
| Frutene | 2.25 |
| Geraniol | 10.50 |
| Ligustral | 4.50 |
| Methyl Iso Butenyl Tetrahydro Pyran | 0.10 |
| Methyl Phenyl Carbinyl Acetate | 3.50 |
| Stemone | 0.30 |
| Terpineol | 1.00 |
| | (30.68%) |
| Base Masking Ingredients | |
| Florhydral | 0.25 |
| Habanolide 100% | 3.75 |
| Alpha-Hexylcinnamaldehyde | 10.55 |
| Iso E Super | 5.00 |
| Lilial | 2.50 |
| Nectaryl | 2.25 |
| Gamma-Undecalactone | 0.60 |
| | (24.90%) |
| Other Ingredients | |
| Methyl Dihydro Jasmonate | 9.87 |
| Para Hydroxy Phenyl Butanone | 0.60 |
| Vanillin | 0.40 |
| | (10.87%) |

PERFUME B

| Perfume Ingredients | Wt. % |
|---|---|
| Blooming Ingredients | |
| Beta Pinene | 1 |
| Citronellyl Acetate | 1 |
| Decyl Aldehyde | 1 |
| Delta Damascone | 0.3 |
| Geranyl Nitrile | 5 |
| d-Limonene | 15 |
| Lorysia | 5 |
| Lymolene | 6 |
| Para Cymene | 2 |
| Terpineolene | 2 |
| Tetra Hydro Linalool | 4 |
| | (42.3%) |
| Delayed Blooming Ingredients | |
| Allyl Amyl Glycolate | 4 |
| Allyl Caproate | 2 |
| Ethyl-2-methyl Butyrate | 0.5 |
| Eucalyptol | 3 |
| Flor Acetate | 5 |
| Frutene | 5 |
| Geraniol | 5 |
| Ligustral | 3 |
| Linalool | 5 |
| Methyl Pamplemousse | 7 |
| Octyl Aldehyde | 1 |
| Phenyl Ethyl Alcohol | 3 |
| Prenyl Acetate | 2 |
| Violiff | 1 |
| | (46.5%) |
| Base Masking Ingredients | |
| Citrathal | 2 |
| Clonal | 0.1 |
| Iso E Super | 5 |
| Florhydral | 1 |

-continued

| | |
|---|---|
| Nectaryl | 1 |
| Neobutenone | 0.1 |
| | (9.2%) |
| Other Ingredients | |
| Methyl Dihydro Jasmonate | 2 |

EXAMPLE I

Stable, liquid compositions of the present invention are as follows:

| | % by weight of active material | | | | | | |
|---|---|---|---|---|---|---|---|
| INGREDIENTS | A | B | C | D | E | F | G |
| Dibenzoyl Peroxide* | 0.9 | 3.6 | 3.0 | 0.5 | 1.5 | 0.9 | 1.8 |
| Carbopol 980 | 0.5 | 1.5 | 0.4 | 0.4 | 1.0 | 0.5 | 0.5 |
| Sodium Hydroxide | 0.07 | 0.3 | 0.1 | — | — | 0.1 | 0.14 |
| Nonionic surfactant (SLF 18) | — | — | — | — | — | — | 5.0 |
| Sodium Citrate | — | — | 10 | — | — | — | — |
| $Na_2CO_3/K_2CO_3$ | — | — | — | 1.0 | — | — | — |
| Sodium Silicate (2.4 ratio) | — | — | — | — | 1.0 | — | — |
| Dispersant (Acusol 480N) | — | — | — | 4.0 | — | — | — |
| Sorbitol | — | — | — | — | — | 6.0 | — |
| Perfume A or B | 0.125 | 0.125 | 0.15 | 0.15 | 0.15 | 0.15 | 0.125 |
| Water + preservative** | Balance to 100 | | | | | | |
| pH (1% in water) | 6.0 | 6.5 | | | | | 6.5 |

*1–10 micron size particles, available as OxyCare 50 ® (50% active) from ABCO Industries.
**100 ppm Neolone M-50 from Rohm & Hass, plus 0.15% Dantogard 2000 from Lonza.

The above compositions are made by slowly adding the Carbopol thickener to deionized water, allowing enough time for the Carbopol to become hydrated, and then adding the benzoyl peroxide, perfume and other ingredients, except caustic, to the mixture. The sodium hydroxide, citrate, carbonate or silicate is then slowly added to neutralize the Carbopol and thicken the product, with any nonionic surfactant added last. The resulting thixotropic gels are particularly useful for removing stains from plastic dishware, while minimizing deposition and filming on the dishware. Composition A is preferably squirted into the main wash dispensing cup of an automatic dishwashing machine, and used as a plastic cleaner in place of a regular automatic dishwashing detergent composition. Composition B is a thicker product that preferably is placed in the pre-wash dispensing cup and used with a regular automatic dishwashing detergent composition. Composition G is preferably a machine cleaning product that is squirted into the main wash dispensing cup prior to the machine being run empty.

EXAMPLE II

Granular compositions of the present invention are as follows. All percentages noted are by weight of the finished compositions, other than the perborate (monohydrate) component, which is listed as AvO.

| Ingredients: | Weight % A | B | C |
|---|---|---|---|
| Catalyst[1] | 0.008 | 0.004 | — |
| Savinase ™ 12T | — | 1.1[2] | — |
| Protease D | 0.9 | — | — |
| Duramyl ™ | 1.5 | 0.75 | — |
| Sodium Tripolyphosphate (STPP) | 31.0 | 30.0 | 33.2 |
| Sodium Carbonate | 20.0 | 30.5 | 29.0 |
| Polymer[3] | 4.0 | — | — |
| Sodium Perborate (AvO) | 2.2 | 0.7 | — |
| Sodium dichlorocyanurate dihydrate[5] | — | — | 2.5 |
| Dibenzoyl Peroxide* | 0.2 | 0.5 | 0.5 |
| 2 R Silicate ($SiO_2$) | 8.0 | 3.5 | 8.5 |
| Paraffin | 0.5 | 0.5 | — |
| Benzotriazole | 0.3 | 0.15 | — |
| PLURAFAC ™[4] | 2.0 | 0.75 | 2.6 |
| Perfume A or B | 0.10 | 0.15 | 0.2 |
| Sodium Sulfate, Moisture | | Balance | |

[1]Pentaammineacetatocobalt (III) nitrate; may be replaced by MnTACN.
[2]May be replaced by 0.45 Protease D.
[3]Polyacrylate or Acusol 480N or polyacrylate/polymethacrylate copolymers.
[4]May be replaced by PolyTergent SLF-18.
[5]Avg. $Cl_2$ = 0.28 – 2.8%.
*1–10 micron size particles, available as Oxycare 50 ® (50% active) from ABCO Industries, preferably added as composite particles containing polyethylene glycol as described in U.S. Pat. No. 5,763,378, Painter et al., incorporated herein by reference.

In Compositions A and B, the catalyst and enzymes are introduced into the compositions as 200–2400 micron composite particles which are prepared by spray coating, fluidized bed granulation, marumarizing, prilling or flaking/grinding operations. If desired, the protease and amylase enzymes may be separately formed into their respective catalyst/enzyme composite particles, for reasons of stability, and these separate composites added to the compositions.

What is claimed is:

1. An automatic dishwashing detergent composition comprising, by weight:

(a) from about 0.01% to about 5% of a blooming perfume composition comprising from about 15% to about 60% of blooming perfume ingredients having a boiling point of less than about 260° C. and a ClogP of at least about 3, and from about 15% to about 70% of delayed blooming perfume ingredients having a boiling point of less than about 260° C. and a ClogP of less than about 3, wherein the weight ratio of blooming perfume ingredients to delayed blooming perfume ingredients is from about 0:25 to about 1.5 and said blooming perfume composition comprises at least about 40% by weight of blooming perfume ingredients and delayed blooming perfume ingredients, and (b) an effective amount of a diacyl peroxide bleaching agent having a particle size of from about 0.1 to about 10 microns wherein at least about 25% of the particles are smaller than 6 microns.

2. The composition of claim 1 wherein said blooming perfume composition comprises from about 20% to about 50% of said blooming perfume ingredients.

3. The composition of claim 2 wherein the weight ratio of blooming perfume ingredients to delayed blooming ingredients is from about 0.5 to about 1.35.

4. The composition of claim 3 wherein the weight ratio of blooming perfume ingredients to delayed blooming ingredients is from about 0.75 to about 1.2.

5. The composition of claim 2 wherein said blooming perfume composition comprises from about 20% to about 50% of delayed blooming perfume ingredients.

6. The composition of claim 1 comprising blooming perfume ingredients selected from the group consisting of: Allo-Ocimene, Allyl cyclohexanepropionate, Allyl heptanoate, trans-Anethole, Benzyl butyrate, Camphene, Cadinene, Carvacrol, cis-3-Hexenyl tiglate, Citronellol, Citronellyl acetate, Citronellyl nitrile, Citronellyl propionate, Cyclohexylethyl acetate, Decyl Aldehyde (Capraldehyde), Delta Damascone, Dihydromyrcenol, Dihydromyrcenyl acetate, 3,7-Dimethyl-1-octanol, Diphenyloxide, Fenchyl acetate (1,3,3-Trimethyl-2-norbornanyl acetate), Geranyl acetate, Geranyl formate, Geranyl nitrile, cis-3-Hexenyl isobutyrate, Hexyl Neopentanoate, Hexyl tiglate, alpha-Ionone, Ionone Beta, Isobornyl acetate, Isobutyl benzoate, Isononyl acetate, Isononyl alcohol (3,5,5-Trimethyl-1-hexanol), Isopulegyl acetate Lauraldehyde, d-Limonene, Linalyl acetate, Lorysia, Lymolene, (–)-L-Menthyl acetate, Methyl Chavicol (Estragole), Methyl n-Nonyl acetaldehyde, Methyl octyl acetaldehyde, beta-Myrcene, Neryl acetate, Nonyl acetate, Nonaylaldehyde, Para-Cymene, alpha-Pinene, beta-Pinene, alpha-Terpinene, gamma-Terpinene, Terpineolene, alpha-Terpinyl acetate, Tetrahydrolinalool, Tetrahydromyrcenol, Undecavertol, 2-Undecenal, Verdox (o-t-Butylcyclohexyl acetate), and Vertenex (4-tert.Butylcyclohexyl acetate), and mixtures thereof.

7. The composition of claim 1 comprising delayed blooming perfume ingredients selected from the group consisting of: Allyl Amyl Glycolate, Allyl caproate, Amyl acetate (n-Pentyl acetate), Amyl Propionate, p-Anisaldehyde, Anisic Aldehyde, Anisole, Benzaldehyde (Benzenecarboxaldehyde), Benzyl acetate, Benzylacetone, Benzyl alcohol, Benzyl formate, Benzyl propionate, beta-gamma-Hexenol (2-Hexen-1-ol), (+)-Camphor, (+)-Carvone, L-Carvone, Cinnamic alcohol, Cinnamyl formate, cis-Jasmone, cis-3-Hexenylacetate, Citral (Neral), Cumic alcohol, Cuminaldehyde, Cyclal (2,4-Dimethyl-3-cyclohexene-1-carboxaldehyde), Dimethyl benzyl carbinol, Dimethyl benzyl carbinyl acetate, Ethyl acetate, Ethyl acetoacetate, Ethyl amyl ketone, Ethyl benzoate, Ethyl butanoate, Ethyl Butyrate, Ethyl-2-methyl butyrate, Ethyl-2-methyl pentanoate, 3-Nonanone (Ethyl hexyl ketone), Ethyl Maltol, Ethyl phenyl acetate, Eucalyptol, Eugenol, Fenchyl alcohol, Flor Acetate (Tricyclodecenyl acetate), Frutene (Tricyclodecenyl propionate), gamma Nonalactone, trans-Geraniol, cis-3-Hexen-1-ol/Leaf Alcohol, Hexyl acetate, Hexyl formate, Hydratopic alcohol, Hydroxycitronellal, Indole (2,3-Benzopyrrole), Isoamyl alcohol, Isopropyl phenylacetate, Isopulegol, Isoquinoline (Benzopyridine), Ligustral (2,4-Dimethyl-3-Cyclohexene-1-carboxaldehyde), Linalool, Linalool oxide, Menthone, 4-Methylacetophenone, Methyl pentyl ketone, Methyl anthranilate, Methyl benzoate, Methyl Phenyl Carbinyl Acetate (alpha-Methylbenzyl acetate), Methyl Eugenol (Eugenyl methyl ether), Methyl Heptenone (6-Methyl-5-hepten-2-one), Methyl Heptine Carbonate (Methyl 2-octynoate), Methyl Heptyl ketone, Methyl Hexyl ketone, Methyl pamplemousse (1,1-dimethoxy-2,2,5-trimethyl-4-hexene), Methyl salicylate, Dimethyl anthranilate, Nerol, delta-Nonalactone, gamma-Octalactone, 2-Octanol, Octyl Aldehyde (Caprylic aldehyde), p-Cresol, p-Cresyl methyl ether, Acetanisole, 2-Phenoxyethanol, Phenylacetaldehyde, 2-Phenylethyl acetate, Phenethyl alcohol, Phenyl Ethyl dimethyl Carbinol (Benzyl-tert-butanol), Prenyl acetate, Propyl butanoate, (+)-Pulegone, Rose oxide, Safrole,Stemone, 4-Terpinenol, Alpha-Terpineol, Triplal (2,4-Dimethyl-3-Cyclohexene-1-carboxaldehyde), Veratrole (1,2-Dimethoxybenzene), Violiff, and Veridine (Phenylacetaldehyde dimethyl acetal), and mixtures thereof.

8. The composition of claim 7 comprising blooming perfume ingredients selected from the group consisting of Beta Pinene, Citronellyl Acetate, Decyl Aldehyde, Delta Damascone, Geranyl Nitrile, lonone Beta, d-Limonene, Lorysia, Lymolene, Methyl Nonyl Acetaldehyde, Para Cymene, Terpineolene, Undecavertol, Verdox, Vertenex, and Tetra Hydro Linalool, and mixtures thereof.

9. The composition of claim 8 comprising delayed blooming perfume ingredients selected from the group consisting of Allyl Amyl Glycolate, Allyl Caproate, Benzyl Acetone, Beta Gamma Hexenol, Cis-3-Hexenyl Acetate, Dimethyl Benzyl Carbinyl Acetate, Ethyl Maltol, Ethyl-2-methyl Butyrate, Ethyl-2-methyl Pentanoate, Eucalyptol, Flor Acetate, Frutene, Geraniol, Ligustral, Methyl Iso Butenyl Tetrahydro Pyran, Methyl Pamplemousse, Methyl Phenyl Carbinyl Acetate, Octyl Aldehyde, Phenyl Ethyl Alcohol, Prenyl Acetate, Stemone, Terpineol, and Violiff, and mixtures thereof.

10. The composition of claim 1 wherein said blooming perfume composition further comprises from about 1% to about 30% of base masking perfume ingredients having a boiling point of more than about 260° C. and a ClogP of at least about 3.

11. The composition of claim 10 comprising base masking perfume ingredients selected from the group consisting of (Ambrettolide) Oxacycloheptadec-10-en-2-one, (Amyl benzoate) n-Pentyl benzoate, Isoamyl cinnamate, alpha-Amylcinnamaldehyde, alpha-Amylcinnamaldehyde dimethyl acetal, (iso-Amyl Salicylate) isopentyl salicylate, (Aurantiol) Methyl anthranilate/hydroxycitronellal Schiff base, Benzophenone, Benzyl salicylate, beta-Caryophyllene, Cedrol, Cedryl acetate, Cinnamyl cinnamate, Citrathal, Citronellyl isobutyrate, Clonal, Cyclohexyl salicylate, Cyclamen aldehyde, Cyclabute, delta-Dodecalactone, (Dihydro Isojasmonate) Methyl 2-hexyl-3-oxo-cyclopentanecarboxylate, Diphenylmethane, Ethylene brassylate, Ethyl undecylenate, Florhydral, Iso E Super, (Exaltolide) Pentadecanolide, (Galaxolide) 4,6,6,7,8,8-Hexamethyl-1,3,4,6,7,8-hexahydro-cyclopenta(G)-2-benzopyran, gamma-Methyl lonone (alpha-Isomethylionone), Geranyl isobutyrate, Habanolide, Hexadecanolide, cis-3-Hexenyl salicylate, alpha-Hexylcinnamaldehyde, n-Hexyl salicylate, Hexadecanolide, alpha—Irone, 6-Isobutylquinoline, Lilial (p-tert.Butyl-alpha-methyldihydrocinnamic aldehyde, PT Bucinol), Linalyl benzoate, (2-Methoxy Naphthalene) beta-Naphthyl methyl ether, Nectaryl, Neobutenone, 10-Oxahexadecanolide, Patchouli alcohol, (Phantolide) 5-Acetyl-1,1,2,3,3,6-hexamethylindan, Phenethyl benzoate, Phenethyl phenylacetate, Phenyl Hexanol (3-Methyl-5-phenyl-1-pentanol), Tonalid (7-Acetyl-1,1,3,4,4,6-hexamethyltetralin), delta-Undecalactone, gamma-Undecalactone, and Vertinert Acetate, and mixtures thereof.

12. The composition of claim 11 comprising from about 3% to about 25% of the base masking perfume ingredients, said base masking perfume ingredients comprising Citrathal, Habanolide 100%, Alpha-Hexylcinnamaldehyde, Iso E Super, Lilial, Neobutenone, Clonal, Florhydral, Nectaryl, or gamma-Undecalactone, or mixtures thereof.

13. The composition according to claim 1 wherein the diacyl peroxide bleaching agent is selected from the group consisting of dibenzoyl peroxide, benzoyl lauryl peroxide, benzoyl succinyl peroxide, di-(2-methybenzoyl) peroxide, diphthaloyl peroxide, and mixtures thereof.

14. The composition according to claim 1 wherein at least about 50% of the particles are smaller than 6 microns.

15. The composition according to claim 14 wherein at least about 75% of the particles are smaller than 6 microns.

16. The composition according to claim 15 wherein the diacyl peroxide bleaching agent is dibenzoyl peroxide.

17. The composition of claim 16 comprising from about 0.1% to about 10% of dibenzoyl peroxide.

18. The composition of claim 17 wherein the weight ratio of blooming perfume ingredients to delayed blooming ingredients is from about 0.75 to about 1.2.

19. The composition of claim 17 in the form of a liquid or gel comprising from about 40% to about 99% of water.

20. A method for cleaning dishware in an automatic dishwashing machine, said method comprising contacting said dishware with an aqueous bath comprising an automatic dishwashing composition according to claim 1.

* * * * *